US008256026B2

(12) United States Patent
Garrigos

(10) Patent No.: US 8,256,026 B2
(45) Date of Patent: Sep. 4, 2012

(54) COMBINED PROTECTIVE GARMENT AND SAFETY HARNESS WITH DETACHABLE PROTECTIVE DEVICES

(75) Inventor: Ramon Olivares Garrigos, Ciudad Real (ES)

(73) Assignee: Oltequip, S.A., Ciudad Real (ES)

( * ) Notice: Subject to any disclaimer, the term of this patent is extended or adjusted under 35 U.S.C. 154(b) by 1022 days.

(21) Appl. No.: 11/910,623

(22) PCT Filed: Nov. 28, 2005

(86) PCT No.: PCT/ES2005/000646
§ 371 (c)(1),
(2), (4) Date: Apr. 28, 2008

(87) PCT Pub. No.: WO2006/106160
PCT Pub. Date: Oct. 12, 2006

(65) Prior Publication Data

US 2009/0064400 A1 Mar. 12, 2009

(30) Foreign Application Priority Data

Apr. 5, 2005 (ES) ..... 200500789
Jun. 6, 2005 (ES) ..... 200501353

(51) Int. Cl.
*A41D 1/00* (2006.01)

(52) U.S. Cl. ..... 2/94; 2/79; 2/160; 2/310; 2/421; 2/456; 182/3; 182/6; 24/3.11; 24/3.13; 24/200; 70/57.1

(58) Field of Classification Search ..... 2/94, 89, 2/329, 85, 86, 102, 108, 69, 44, 305, 51, 2/81, 251, 254, 160, 79, 308–312, 101; 182/3–7, 182/192; 24/241 P, 232 R, 234, 242, 3.13, 24/909, 198, 200, 3.11, 3.1, 3.7; 224/578, 224/583, 575, 576, 577, 241 P, 232 R, 234, 224/242; 70/57.1
See application file for complete search history.

(56) References Cited

U.S. PATENT DOCUMENTS 972,535 A 10/1910 Baxter
3,214,771 A 11/1965 Treiber
(Continued)

FOREIGN PATENT DOCUMENTS

EP 0208813 1/1987
(Continued)

*Primary Examiner* — Khoa Huynh
*Assistant Examiner* — Khaled Annis
(74) *Attorney, Agent, or Firm* — Sturm & Fix LLP

(57) ABSTRACT

The invention relates to an integral protective work clothing item comprising releasable integrated retaining elements and a digitally-activated retaining fastener. The inventive clothing item includes a harness and a retractable mechanism for securing a user to a standard lifeline. The item also comprises additional protective elements, such as a helmet, gloves and shoes which are connected thereto by means of respective elastic bands. Each of said bands is equipped with a hole for a fastener device that can only be released using a device designed for said purpose. The digitally-activated fastener comprises an electromagnet, a mobile discoidal part and a spring element. The cover of the fastener casing is provided with a hole and a tubular formation in which a pin or rod can be inserted and guided. In the operative position, the core of the electromagnet retains the rod in place and prevents the removal thereof, such that the casing and the rod are connected to one another and can only be released using the separate releasing device.

13 Claims, 8 Drawing Sheets

U.S. PATENT DOCUMENTS

| | | | | | |
|---|---|---|---|---|---|
| 3,364,532 | A | * | 1/1968 | Hatfield | 24/658 |
| 3,638,285 | A | | 2/1972 | Sanchez | |
| 4,273,215 | A | | 6/1981 | Leggett | |
| 4,527,310 | A | * | 7/1985 | Vandebult | 70/57.1 |
| 4,731,882 | A | * | 3/1988 | Ekman | 2/69 |
| 4,993,245 | A | * | 2/1991 | Ott | 70/57.1 |
| 5,099,228 | A | * | 3/1992 | Israel et al. | 340/572.1 |
| 5,544,363 | A | * | 8/1996 | McCue et al. | 2/102 |
| 5,974,591 | A | | 11/1999 | Leslie | |
| 6,024,091 | A | | 2/2000 | Bennett | |
| 6,393,677 | B1 | * | 5/2002 | Anscher | 24/630 |
| 6,421,834 | B2 | * | 7/2002 | Kester | 2/94 |

FOREIGN PATENT DOCUMENTS

| | | |
|---|---|---|
| EP | 0537009 | 4/1993 |
| ES | 2187335 | 6/2003 |
| GB | 509649 | 7/1939 |
| GB | 2144970 | 3/1985 |
| WO | 0053038 | 9/2000 |

* cited by examiner

COMBINED PROTECTIVE GARMENT AND SAFETY HARNESS WITH DETACHABLE PROTECTIVE DEVICES

CROSS REFERENCE TO RELATED APPLICATIONS

This application is the U.S. national stage entry of PCT/ES2005/000646, International Filing Date: Nov. 28, 2005 claims foreign priority to P200500789, filed Apr. 5, 2005 claims foreign priority to P200501353, filed Jun. 6, 2005.

THE OBJECT OF THE INVENTION

This invention refers to an integral protective work clothing garment, with releasable retaining elements incorporated. Especially, the invention proposes the development of a work clothing garment that has all of the elements and devices necessary for the integral protection of the garment user, in that each and every one of these protective elements are individually linked to the garment in a separate manner, independently, in the positions that correspond, each one using a means of respective anchoring or retention that allows it to be removed for the release of the protective means connected when a release device designed for that purpose is applied to said retainer. In addition, the invention provisions for the incorporation of a harness into the garment, which may or may not be capable of user regulation, the garment also having a lining, and with an anti-fall device being fitted in a specific position, preferably with, a retractable mechanism capable of being fitted to the harness in the dorsal or ventral position, or even in another position on the safety belt, with the assistance of one or more support pieces that are specially designed for this application, where the support parts are also capable of being anchored or retained together by means of a releasable device.

Likewise, another aim of this present invention is the development of a retaining device specifically designed for the envisaged application, made from a fastener or lock prepared for the joining of two or more parts, independent or separate elements, capable of being released by means of applying a digital signal from a release device made for connecting to the fastener or lock at the moment of its release, and capable of generating the digital signal, programmed or not, that is recognisable by the electronics included in the fastener.

The field of application of the invention is clearly included amongst the industrial sector, involved in the manufacture of working clothes, especially working clothes designed for integral user protection.

BACKGROUND AND SUMMARY OF THE INVENTION

The fact is known by experts in the matter in regard to the regulations for work safety, especially the Law for the Prevention of Labour Related Risks, provision for the need for workers tasked with carrying out certain types of work in which they are exposed to certain risks, to make use of a diversity of elements that guarantee adequate protection for the different parts of the body. Likewise, in accordance with the regulations, depending on the nature of the works that have to be carried out, the worker must include components such as, a helmet or safety hat (with or without safety goggles, with or without ear protection, with or without face mask, in their individual protection equipment, without forgetting those helmets that are specifically defined for certain types of specific work), gloves, boots, etc. In addition, it is also frequently necessary for the working garment to be fitted with some type of harness that, where appropriate, allows the worker to be suspended from a "life line", or other fixed or mobile anchorage points, with the use of some type of elastic, especially with a view to protecting the worker in the event of an accidental fall or a similar occurrence.

The problem that has been detected in practice is that all of the previously stated safety components, in spite of their use being compulsory, are sometimes not used by the worker in the due manner, or even frequently they do away with some of them, thus subjecting themselves to the corresponding risks in an absolutely unnecessary manner.

On the other hand, the existence of devices designed and created is known specifically for the connection of two separate elements to each other, for the purpose of one of them being used as a means of protection from the other, and in which the first is capable of being separated from the second at the moment of acquisition or the use of the latter. Such a case, for example, is that of the department stores or other types of shops, in which each item on display for sale has a means of protection that, in combination with the anti-theft bars installed in differing places in the areas of compulsory passage, set off the alarm devices in the event of any of these protectors passing through the protected areas, preventing such articles from being stolen. When the customer purchases one of these protected articles, an authorised employee applies a release mechanism over the protector device to carry out the effective separation between the protector device and the article acquired, thus enabling the latter to be taken out of the establishment.

With a view to preventing the previously referred to practical situations, in which the user of a work garment that has protective elements incorporated, being able to acquire the habit of leaving some of these protector elements in the situations in which they are required, in the current state of the art the technique of incorporating said components in the garment itself are known, in such a way that the worker has one of them within reach, and making the act of not using them more uncomfortable. With this an attempt at the correct use of the different protective elements has been developed. Along these lines, the existence of Spanish Patent No ES-2 187 335 is already known, in which an integral working safety garment is described that is made up of an overall into which a harness has been incorporated, that is fixed or stuck to the overall (visibly located on the outside of the overall), and in which the protective components include a helmet joined to the overall or harness by means of a flexible strip that prevents the physical separation of both elements, the same as happens with gloves, boots or goggles, also planned as an integral part of the protective equipment. Likewise, the inclusion of an anti-fall device has been provisioned, that is fixed by means of a support via a ring linked to an elastic element intended to dampen the effect of an eventual fall.

However, in spite of the fact that the working garment described in this patent document has undeniably meant a significant advance towards improving the protection of users, it is certain that it is not free from a series of difficulties that make it practically unusable. Thus, the type of fixing chosen for the connecting of the differing components with the garment (a flexible strap), are totally unsuitable, due to the fact that each one of the protective components (helmet, gloves, boots, . . . ) has a different useful working life: the average life of a helmet is calculated at around 3 to 5 years, whilst that of some gloves can be in the order of 1 to 6 months, that of footwear can be between 6 months and one year, whilst that of protective goggles can be in the order of 1 to 3 years, and so on successively; this means that in the case of a working garment conceived as in the earlier technique, the breakage with use of any of the components (helmet, gloves, . . . ) would mean the throwing away of the complete outfit, which would be totally uneconomic, or having the availability of resources or personnel that could be entrusted with the replacement of the damaged, worn or expired element for another one with the same characteristics, which would also become highly disadvantageous from the economical point of view and the investment in time and labour. In a like manner, the external placing of the harness could give rise to undesirable and dangerous snagging under certain situations, as also occurs with the fixing strap of the helmet that appears joined to the overall at the front, from a position located at chest level.

Taking the disadvantages associated to the working clothing of the type stated into account, of the types available in the current state of the art, this present invention has proposed the design of a noticeably improved garment as its main objective, with the differing protective elements incorporated into same, but in such a way as to become really effective, practical and functional for the differing activities in which they could be used. This objective has been fully fulfilled by means of the garment that is going to be the object of the description in the following part, whose main characteristics are contained in the characterising part of the annexed claim 1. In a like manner, and in accordance with the second main objective of the invention, a digitally activated fastener or lock is provided, for the fixed and safe connection between the working garment and each and every one of the differing protective elements joined to same, whose main characteristics are contained in claim 7 that follows.

In essence, as has been stated previously, the improved working garment proposed by the invention, is of the type which already incorporates each and every one of the elements that are necessary for the integral protection of the user of same, but in such a way that each one of said elements is anchored to the working garment with the aid of a releasable device that allows separation and replacement of a damaged, worn out or expired component, in a simple and quick manner. The means of joining each protective element with the work garment, has been designed as a "lockable" retainer, in such a way that it cannot be manually separated, but the opening of the lock demands the use of a releasing device that has been especially designed for that purpose (which does not form part of this present invention); this possibility of change and replacement of the differing components guarantees that the worker has the complete protective equipment available at all times and in perfect working order.

On the other hand, the invention has provisioned for the working garment to incorporate a harness integrated on the inside of the garment, with the use of a lining that, sewn to the suit, allows a housing to be formed in the form of "track", suitable for the entire travel of the harness. The anti-fall device fitted to the harness is made up from a reduced weight retractable mechanism, that is fixed to the harness in previously specified positions, and which can be selected on the user's back area or equally on the front, or even be fitted on the side position to a safety belt worn by the user, this retractable mechanism even being able to be covered or lined with some type of cushioned protection to prevent damage to the user in the event of a fall. The fixing between the harness and the retractable device is carried out with the help of one or more intermediary parts designed for that purpose, as will be described below, and joined to the retractable device itself by means of an element that allows its separation from the harness when it is necessary.

Also, in accordance with the invention, it has been provisioned that the work garment incorporates a pocket on each sleeve, fitted with a closing zip (or another means with similar characteristics), adapted so that the user is able to put away the gloves on those occasions in which their use is not necessary.

In addition the working garment, designed in accordance with the invention, allows it to be manufactured in a multiplicity of textile varieties, which makes its use especially ideal for use in certain specific situations. Hence, garments can be obtained for high visibility, garments especially adapted to the construction industry, other types for chemicals (treated individually in each case depending on the chemical product to which they are going to be exposed), dielectric types, special garments for fire and heat, garments for winter and summer, . . . , etc.

Also, in accordance with a variation of the invention, and provided that its application will allow, the working garment can be designed in two parts, namely, jacket or waistcoat and trousers, fitted with the same protective equipment, being able in one of the last two cases to have a harness and a retractable mechanism incorporated, and in the other case being able to be free of these two elements.

As will be understood, a working garment conceived and designed in the way that has been explained above, means a substantial advance compared to other currently known garments that exist, noticeably improving the functionality and operating conditions of these types of garments, and in addition guaranteeing the change or replacement of any component that becomes damaged, worn out or expired, so as to keep the garment in perfect working conditions.

As for the retaining fastener designed by the invention, it has been conceived with reduced dimensions and weight, the mechanisms of which, together with the electronics which activate it, are to be found housed on the inside of a small box designed for that purpose. On the inside of this box there is an electro-magnetically activated retainer element, the core of which is made from a cylindrical body with a part of one end having a smaller diameter and which moves a short distance, sufficient to be housed in, or exit from, a perimeter neck made from a retaining rod that penetrates into the inside of the box through an opening made for the purpose, in such a way that it holds, or respectively releases, said rod in regard to the coupling with the box fastener. The stated rod has a head with a considerably greater diameter at the opposite end to that of the introduction, which when in the rod introduced position is separate from the plane of the box by a pre-determined distance, sufficient to house the parts or elements that have to be kept joined to each other. In addition, in another pre-determined position of the box, provision has been made for the incorporation of a suitable connector, intended to receive a connecting cable with a release device when it is required to release the rod from the connection, and in doing so the separation of the previously connected pieces.

As will be understood, one embodiment of that mentioned, allows the electrical supply of the fastener to be made from the release device, at the moment of the inter-connection of this with the fastener, in so doing avoiding the latter having to have batteries, thus reducing the weight of the working garment assembly into which it is fitted, and also reducing the possibility of an eventual unwanted manipulation attempting to release the fastener.

Even though the fastener has been defined in the above as a device specifically designed for application to working garments, it will be understood that one preferred application is being dealt with by virtue of the construction and design characteristics, but under no circumstances can it be understood as being by way of limitation, as the fastener is perfectly applicable to any other situation in which two separated elements must be kept together, and the free part of the fixing rod so permits.

A BRIEF DESCRIPTION OF THE DRAWINGS

These and other characteristics and advantages of the invention will become clear from the following description of a preferred embodiment, which has the character of a non limiting example, illustrated in the annexed drawings, in which.

Figure 6:
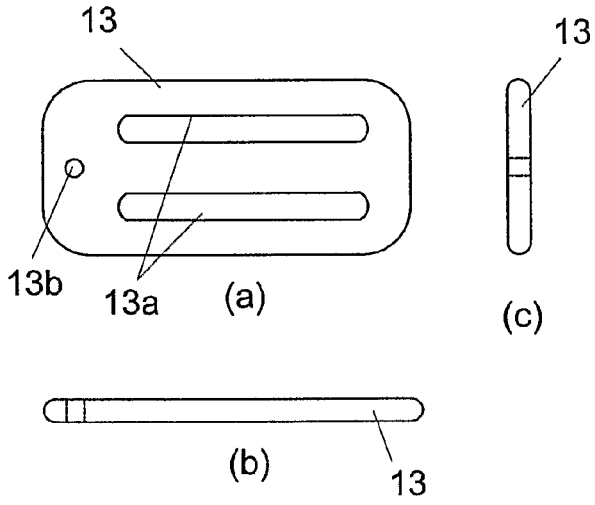
FIG. 6 shows a plan, side elevation and profile view, respectively of those shown as (a), (b) and (c), of a part designed for direct or indirect connection to the harness of the working garment, in this latter case by means of this or more support pieces designed for that purpose.
Figure 8:
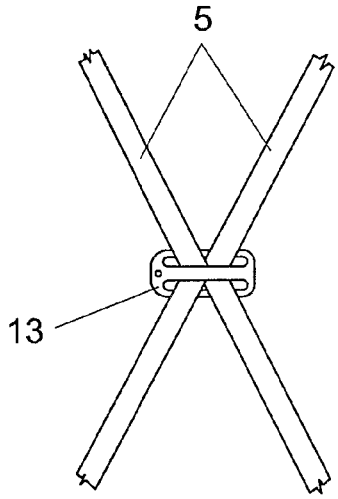
Figure 9:
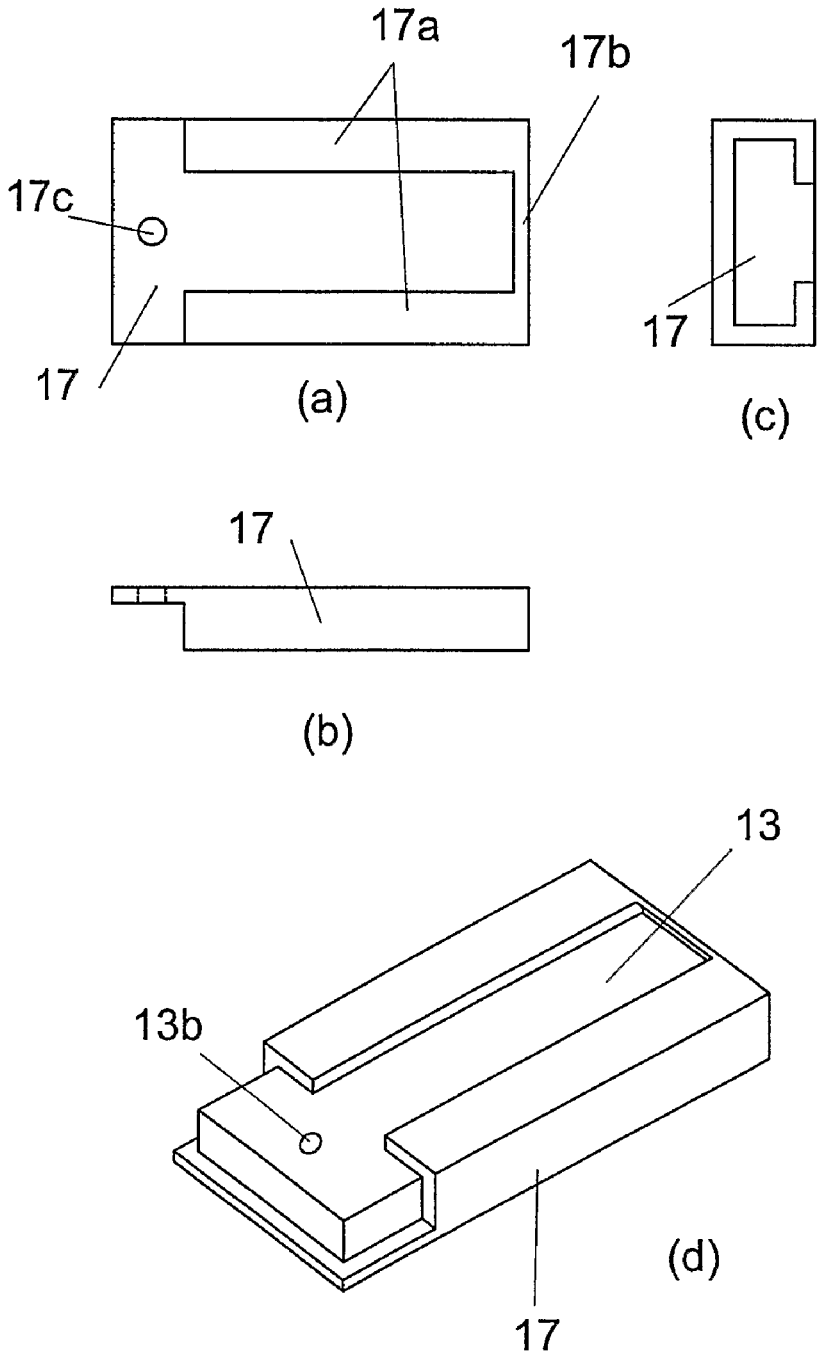

FIG. 8 is a diagrammatic representation of the coupling between the support pieces shown in FIG. 6 and the harness straps, and Finally, FIG. 9 shows various representations in plan, lateral elevation, profile views, respectively (a), (b) and (c), of a support piece used as a support device for the connection part shown in FIG. 6 to the retractable device, together with a perspective representation (d) of the connection piece of FIG. 6 coupled to said support piece.

Figure 10:
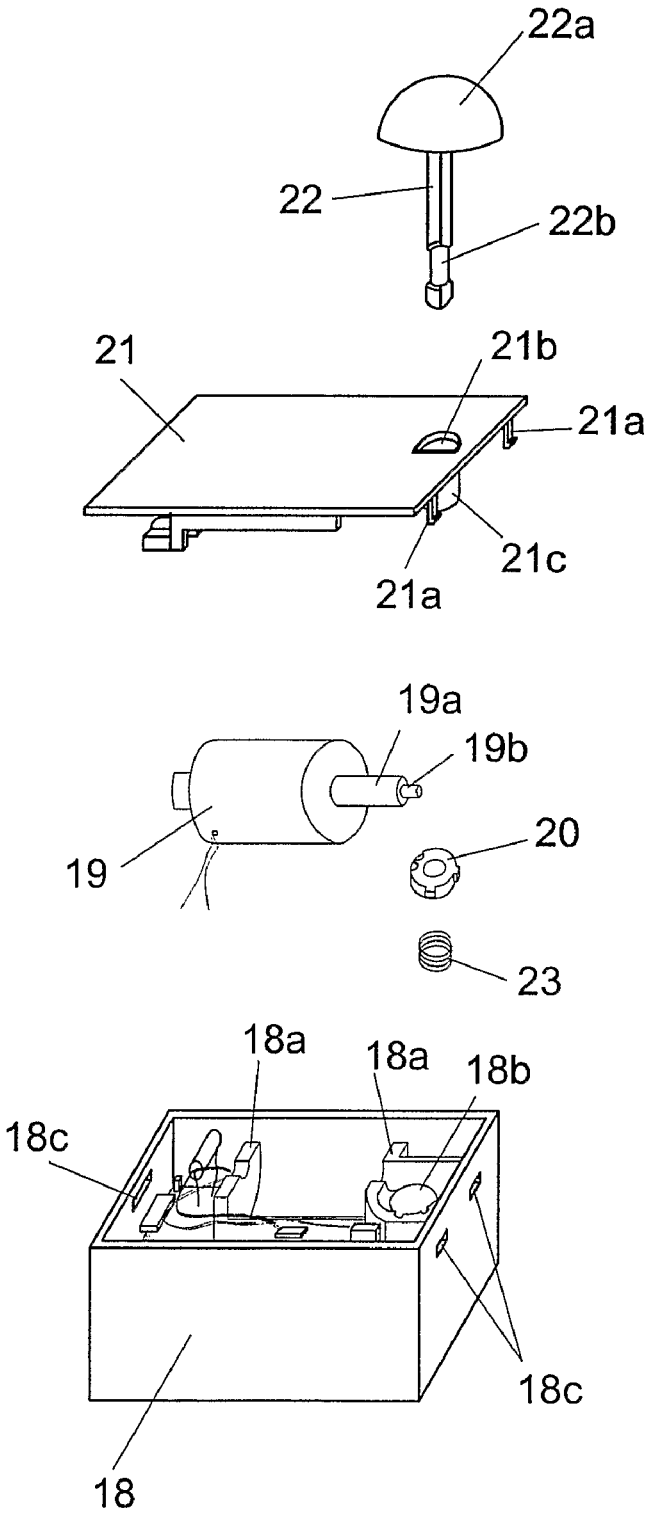

FIG. 10 is a diagrammatic view, in perspective, of a breakdown in which the different elements that make up the fastener device of the invention have been considered.

Figure 11:
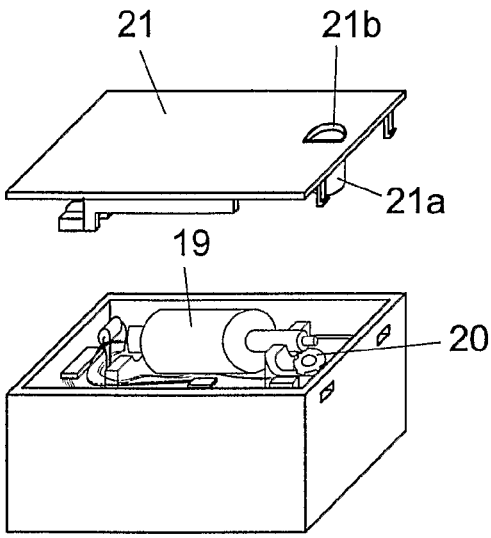
Figure 11A:
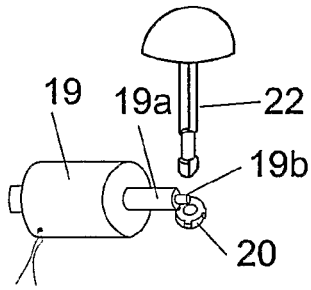
Figure 11B:
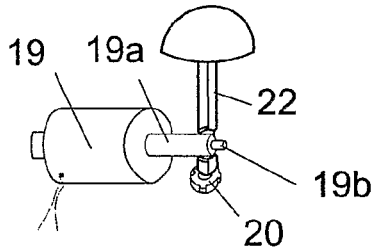
Figure 12:
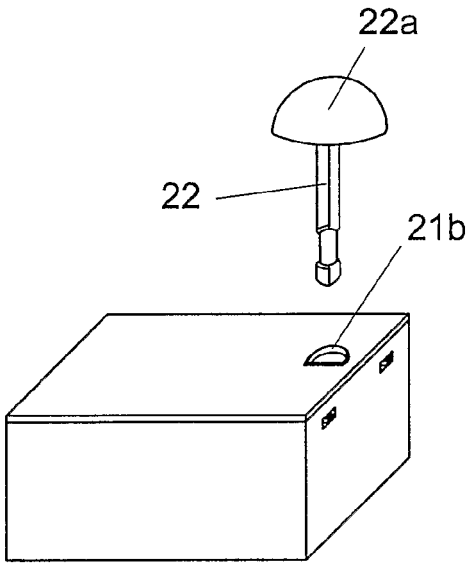
Figure 13:
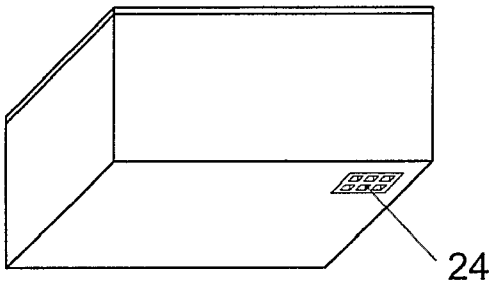
Figure 14:
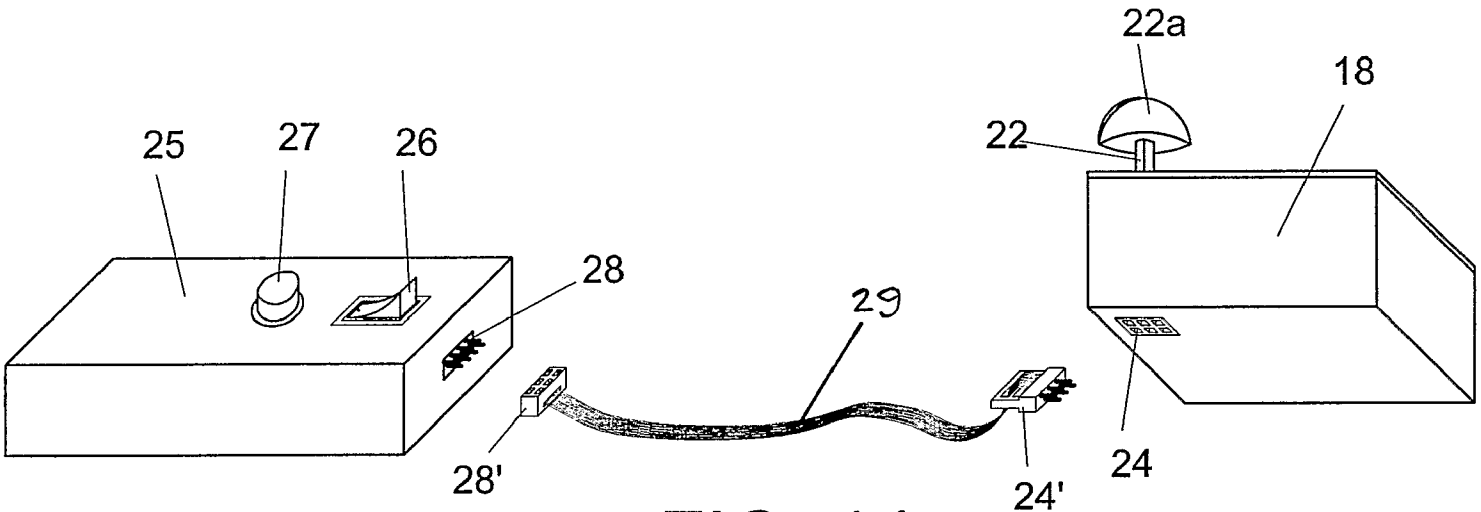

FIGS. 11, 11*a* and 11*b* show diagrammatic views in perspective, in which the fastener of FIG. 10 can be seen, assembled with a separated upper lid, the internal electromagnet in the release position and the internal electro-magnet in the locked position, respectively;

FIG. 12 represents a diagrammatic view, in perspective, of a fastener constructed in accordance with the invention, with the retention rod located over same, and facing the introduction opening towards the inside of the fastener box;

FIG. 13 is an illustrative view of the provision of a connector in the fastener box, and FIG. 14 represents, finally, a view of an application of the release device for the fastener during the release operation of the latter.

A DESCRIPTION OF A PREFERRED EMBODIMENT

As and how stated in the above, the detailed description of the preferred embodiment of the invention is going to be carried out in the following with the help of the annexed drawings, by means of which the same numerical number references will be used to designate the same or similar parts. Hence, in the first place starting with FIG. 1, the general diagrammatic representation of an improved working garment can be seen in accordance with the invention, indicated with reference (1). In accordance with the conception of this type of garment, this shows the equipment necessary for the complete protection of the user, made up of the garment, and comprising a series of independent elements such as a helmet (2) (or where appropriate a safety hat), provided with goggles, a pair of gloves (3), and a pair of boots or shoes (4) (depending that which corresponds). These component elements of the protection equipment are jointly connected to the garment (1) by means of strips (6) respectively, preferably elastic (hereinafter in the description the expression "elastic strips" will be used), sufficiently resistant to prevent easy breakage even though the user is exercising a specific traction on them. Special mention must be made to the fixing point of the elastic strip (6) between the helmet (2) and the suit (1), for which the overlap or collar (1*a*) of the garment itself is used, in its projection from the rear edge of the latter, which means that it avoids strip (6) having to be too long, thus also preventing possible unwanted snagging that could arise from an excessive or unsuitable length.

As can be understood, the helmet (2) with goggles, or the safety hat in replacement, the gloves (3), the boots (4), or any other element that forms part of the equipment of the garment, will be conventional, of the type that is best suited to the differing needs, hence they will not be explained in greater detail in this present description.

Figure 1:
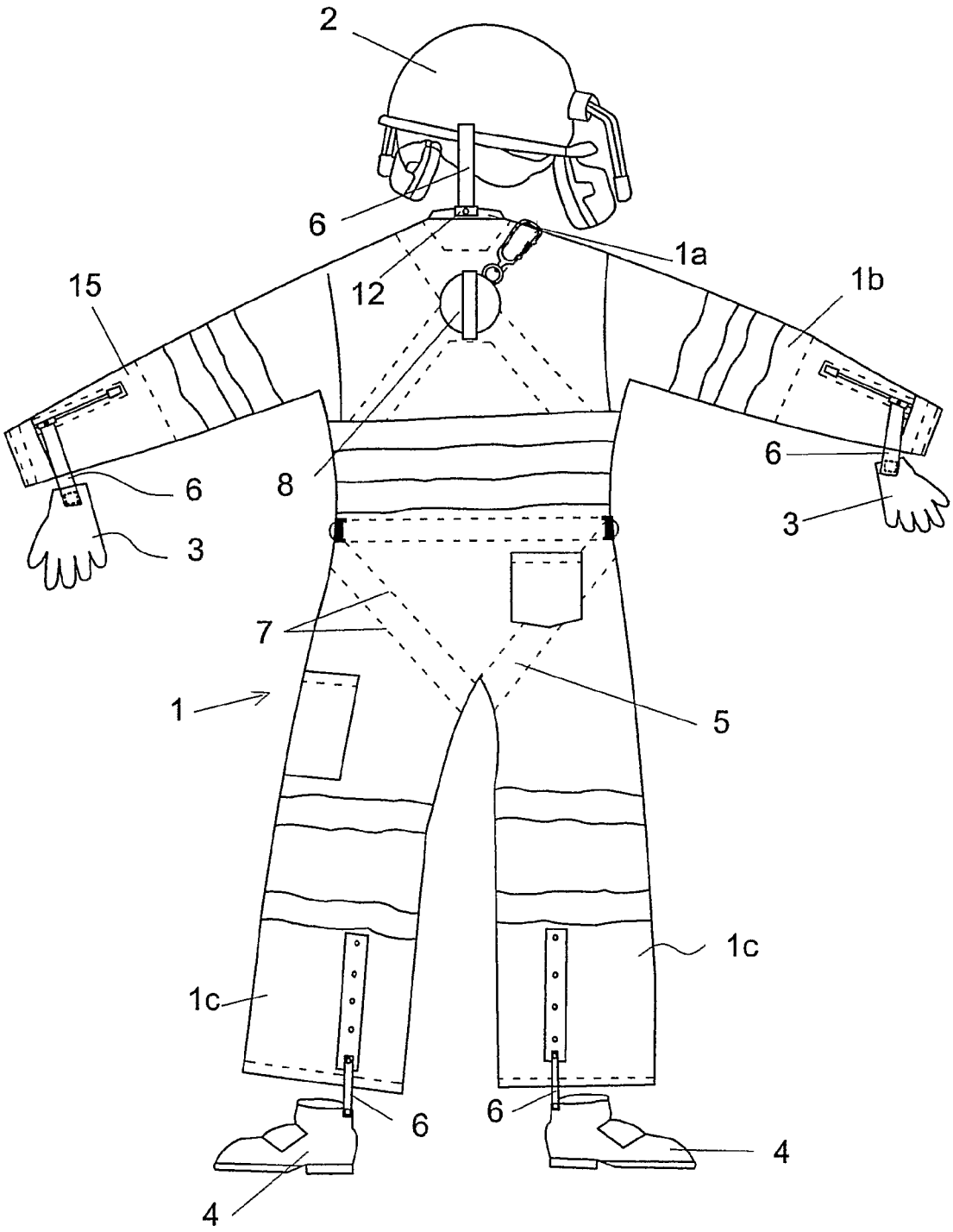
FIG. 1 shows a general schematic view of the working garment, with each and every one of the protective elements integrated into the garment.

The location of a harness (5) to the garment (1) can also be seen in FIG. 1 in such a way that it is located on the inside of the garment, preventing snagging, rubbing or any other undesirable situation that could mean its undue deterioration or wearing. The fixing between harness (5) and the textile making up the garment (1) is made with the use of an internal lining and preferably with the use of stitching (7), which means a track or guide for the harness, and suitable protection for same. In addition, if required, depending on the garment type, the latter can have an access to the harness on the front of the garment so as to allow the user to be able, in a normal manner, to carry out an adjustment of same to his or her individual physical and body conditions.

Also, in this same figure it can be seen that the harness on the back of the garment has been fitted with an anti-fall device in a pre-determined position, connected to the harness in the manner to be explained subsequently, for which purpose the garment has a suitably sized access opening. The anti-fall device has been given reference number (8), and consists of a conventional type of retractable mechanism, advantageously modified for the specific purpose to which it is to be put, as will be seen subsequently.

Figure 2:
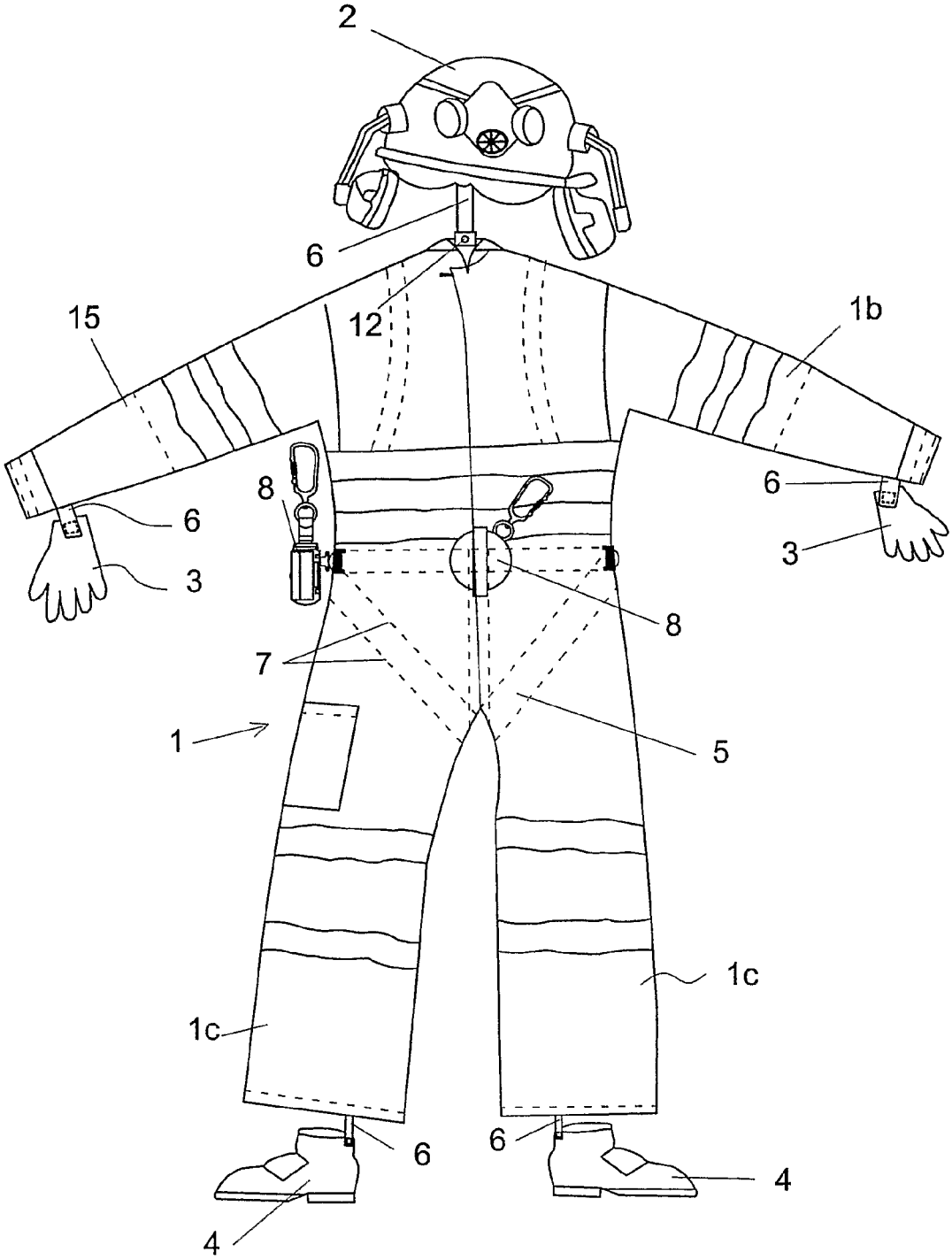
FIG. 2 shows a similar schematic view of the above, but in this case taken from the front of the garment so as to show the different possible retractable fixing points at the front.

However, it must be clarified that the position chosen in FIG. 1 for the location of the retractable device, must not be understood in any way as being by way of limitation, but solely for illustrative purposes, as the connection between the garment and the retractable device can be made in other positions, such as, those which are made in FIG. 2, as seen in a front elevation view of the garment (1), with respective retractable devices (8) located respectively in the ventral position and the lateral position. With this, other alternative possibilities of unions between both elements are illustrated. It will be understood that in the alternative embodiments, the simultaneous use of two or more retractable devices can be provisioned for in rear positions and/or front ventral positions and/or lateral positions in a simultaneous manner.

Figure 3:
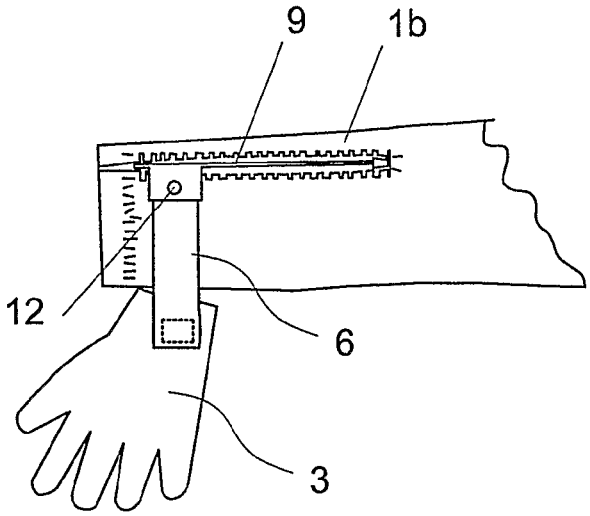
FIG. 3 shows a detail of a sleeve of the working garment, fitted with a pocket next to the cuff.

Now looking at the representation of FIG. 3, one of the sleeves (1*b*) which is fitted to garment (1) can be seen in greater detail, from which a glove (3) is hanging by means of the corresponding elastic strap (6). As can be seen the stated elastic strap (6) comes out at the upper end, from the inside of an opening whose passage is capable of being closed by means of a zip (9). This opening arrangement constitutes the access to an internal space or pocket, designed and sized in such a way as to accept the introduction of the corresponding glove (3) when the worker is not using it. In this way, a housing is provided in each sleeve that allows the respective glove to be put away, avoiding it having to remain "hanging" when not in use, and thus preventing the possibility of undesirable snagging that could give rise to situations of risk and even accidents. The releasable fastener device between the glove (3) for the fixing of the glove is connected to the upper end of strip (6), for which there is a corresponding opening for this purpose with another being made on the inside of the opening, the glove being joined to the opposite end of the elastic strip, preferably by means of stitching.

Figure 4:
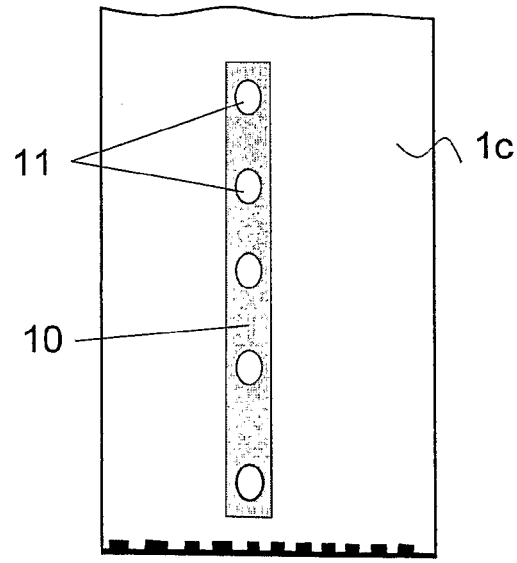
FIG. 4 shows a detail of the trouser leg of the garment arranged for the anchoring of the boot (or where appropriate, the shoe), in different positions.

In that which refers to FIG. 4, the lower rear part of trouser leg (1*c*) of the working garment can be seen in greater detail. This lower part of the trouser leg includes a section (10), along which several holes (11) have been made which are in line, provisioned for the anchoring of the boot or shoe of that leg to the trouser leg (1*c*). As can be understood, the provision of a specific number of holes (11), allows the user to be able to choose the position of the connection and coupling of the boot or shoe (4), in accordance with his or her size, even being able to fold it over itself in any position of the excess of the trouser leg, and in so doing adapt it in the best way to his or her physical characteristics.

Figure 5:
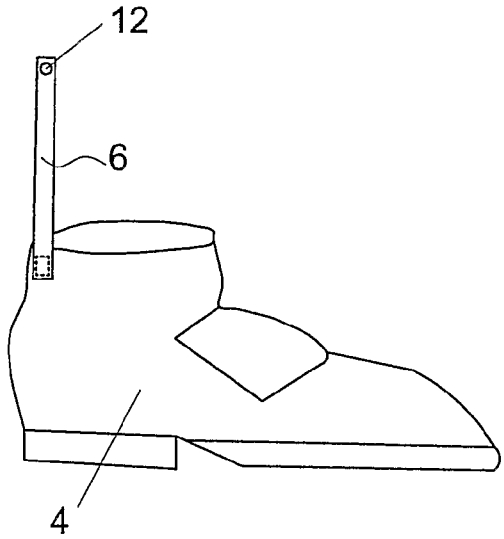
FIG. 5 shows a representation of an example of an integrated component (in this case a boot), fitted with the connection device to the working garment.

In the same way as that already mentioned, FIG. 5 is intended to show a diagrammatic representation of an example of a boot or shoe (4) capable of being used with the above described working garment (1). As and how shown, the coupling of the boot or shoe (4) to the trouser leg (1*c*) is carried out by an elastic strip (6), with the same characteristics as already mentioned above, fixed by the end of its lower part to the rear of the shoe, and provided with an opening at its opposite end to allow the passage of the retaining element (the fastener (12)).

In the above description of the different elements that make up the protective equipment incorporated into the working garment, continuous mention has been made about the coupling between those elements and the garment (1). However, that coupling is releasable, so that when an element, included in the garment itself, needs to be replaced because of breakage, wear or any other circumstance, its replacement is carried out by a worker with the skill to do so and provided with a relevant release device, in a simple, quick and easy manner. In order to do this, the fastener device has been designed specifically for this operation, and its conception has been materialised in the form of a "digital lock or fastener". One of these fastener units is fitted to each one of the elastic strips (6) for the connection of each element to the garment (1), for which purpose the stated elastic strips have an opening made at the end for the application of the fastener. As can be seen, the coupling fastener (12) is small in size and light in weight.

As and how stated previously, the garment is fitted with one or more anti-fall devices (8) connected to the harness in one or more pre-determined positions, namely, at the back of the garment or in a ventral or lateral position. For the purposes of the invention, with the intention of providing greater safety for the user, an anti-fall device has been chosen that is made from a retractable device, of the type that is made on the basis of a metallic or non-metallic rigid structure, fitted with a casing, and in which the weight has been suitably reduced, to which one or several means of intermediary support are fixed in a firm manner, in accordance with the invention they have been designed specifically to take and retain the respective part of the union to the harness with the help of the fastener. One specific illustration of this intermediate harness coupling piece is shown in the representations in FIG. 6, whilst the support piece, designed complementarily with said coupling piece of FIG. 6 has been shown from different vies in FIG. 9, which will be discussed subsequently.

In accordance with FIG. 6, plan (a), lateral elevation (b) and profile (c) views can be seen, of a union piece to the harness, identified with reference number (13), and which as can be seen consists of an appreciably flattened body, with a generally prismatic rectangular shape, into which one or more through slots (13*a*) have been made, going in a longitudinal direction, parallel to each other and separated by a predetermined distance. Close to one of the ends of the piece there is a through hole provided, identified with number (13*b*), and suitably sized for the application of a retaining element (the digital fastener to which reference is made throughout this present description).

Complementarily with piece (13) shown by the different views of FIG. 6, the invention has provisioned for the design and use of a support piece, the structural characteristics of which can be seen in the plan (a), lateral elevation (b) and profile (c) views of FIG. 9 of the drawings. In accordance with these representations, the stated intermediary support piece consists of a flat base structure (17), closed at one end by means of a transversal wall (17*b*), fitted at the other end with a through hole (17*c*), and likewise having both side walls vertically coming out, that are finished off by means of tabs (17*a*) respectively facing each other, facing towards the inside in regard to the co-planarity, and in such a way that between said side tabs (17*a*) and the stated transversal wall end (17*b*) there is a suitably sized space outlining the base to receive and house the piece (13) of the union to the harness. This situation has been illustrated by means of the representation 9(*d*), in which said intermediary union piece (13) appears housed on the inside of the space offered by the intermediary support piece (17), in operating position, with which both holes (13*b*) and (17*c*) respectively of each one of the pieces are now facing one another, allowing the possibility of making the releasable retaining element (a digital fastener, not illustrated) to pass through same to make the connection and retention of one to the other in said operating state.

Figure 7:
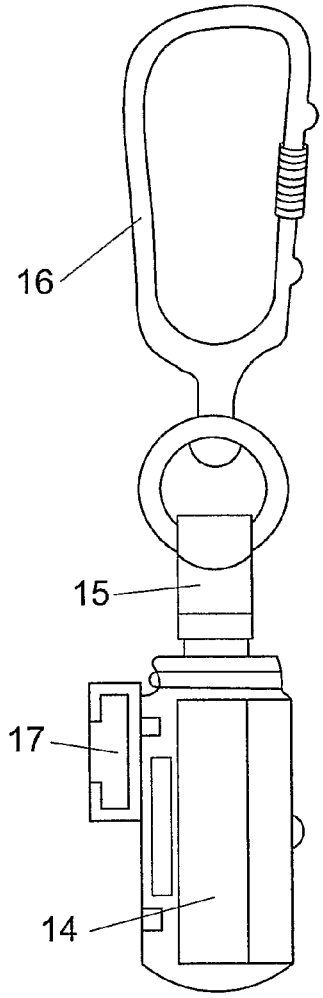
FIG. 7 shows a diagrammatic view of a retractable device provided for fixing to the harness shown in FIG. 6.

FIGS. 7 and 8 are likewise illustrative of the working conditions of both of the mentioned intermediary pieces. If the representation made in FIG. 7 is looked at it can be seen that in same there is an example of the retractable device, currently preferred by the invention, identified with number (14), to which structure (metallic or non-metallic) the intermediary support piece (17) is fixed, which was previously described and is prepared to take the intermediary union piece (13), as stated above. This union piece (13), as shown in FIG. 8, allows the safe coupling of the harness straps (5), by virtue of the proposed design, making said straps pass through each one of the through slots (13*a*) which have been provided. With the union piece held in this way to the harness, its introduction can be carried out to the inside of the intermediary support piece (17) fixed to the retractable part (8) (FIG. 9*d*), ensuring and immobilising this coupling with the help of a releasable digital fastener, with it guaranteeing perfect safety and protection for the user. The fixing of the retractable piece to a "life line" or to any other fixed or mobile support point is carried out with the help of the coupling (16), preferably of the snap ring type, connected to the retractable device by means of the strap (15) that is finished off at its free end in a loop form so as to make its fixing to said hook easier.

The representation that appears in FIG. 8 is illustrative of the coupling between the support part (13) and the harness straps (5) at a near or crossover point of the latter, as in the rear position. In accordance with that which can be seen, said support piece (13) materialises and reinforces the near point or crossover, giving it some increased safety and firmness characteristics. As has been said, especially in the case of the rear positioning of the retractable device (14), the invention has provisioned that this latter can be covered with cushioning to prevent the user from being hurt in the event of a fall backwards with the retractable part incorporated into the harness.

As can be understood from the above description, the working garment conceived and improved in accordance with the invention ensures a level of protection to the user that cannot be guaranteed with the currently known similar garments in the present state of the art. In addition, the use of a working garment of this type means a very significant financial saving, on enabling any element or component of the protective equipment to be replaced when necessary, guaranteeing that the entirety of it is always kept in the best operating conditions for the user, since the latter cannot detach any of the protective elements as the connection to the working garment is made by means of the so called "digital fasteners or locks", and the use of a special releasing device is necessary, as has been said, under the control of a single person in charge, for the opening of said fastener and the releasing of the corresponding element.

Additionally, as stated at the beginning of the description, the protective and safety characteristics provided by the improved working garment of this present invention are boosted and complemented by the possibility of choice of the characteristics of the textile used for the manufacture, in such a way that the end product can have reflective or high visibility characteristics, which are especially suitable for use in construction works, it may be particularly useful for working with chemical products, it can be especially insulating from the electrical point of view, it can be insulating against fire (flameproof nature) and to heat, or even it can be especially recommended for use with higher or lower temperatures, or even some parts of the garment can be reinforced for use in specific jobs, all of which evidently is in line with the particular application for which it has been designed.

As has been stated throughout in the above description of the working garment, the firm and fixed coupling between each one of the safety components of the working garment and the garment itself (1) are carried out with the help of a releasable retaining device constituted by a digitally activated fastener or lock, the structural and functional characteristics of which are going to be explained in detail below. In this regard, in the first place paying attention to FIG. 10 of the drawings, it can be seen that there is a diagrammatic representation, in perspective, of a breakdown of the embodiment of the fastener of the invention. In accordance with said representation, the fastener has a reduced sized box (18), made from a plastic or metal material, depending on suitability, on the inside of which different operating components of the fastener are housed, basically comprising an electro-magnet (19) fitted with a cylindrical, axially moveable core, in which a difference is made between the first portion of the core (19*a*), and an end portion (19*b*) with a smaller diameter than the first, in which the union with the first is defined by a step as a result of the differing diameters. The electro-magnet (19) is located in specific housing on the inside of the box (18) by means of two transversal walls (18*a*), that are parallel and formed in pre-established positions so as to keep said electro-magnet in its corresponding position.

Also, as part of the operating components of the assembly, the fastener of the invention incorporates a disc shaped piece (20), with reduced thickness and diameter, sized for housing with the possibility of axial movement in a small cavity (18*b*) made in the back of the box (18), with a spring (23) first placed in and compressed by said disc piece (20), and with its recovery action pushing the latter in an upward direction according to the position in which the box (18) is represented. The situation of the disc piece (20) is such that the axially moveable core of the electro-magnet (19) remains located in a position opposite same, in such a way that, when the disc is axially moved or not, it will be the portion (19*a*) or the portion (19*b*) that is located on the stated disc piece (20).

The box is closed by the access base by means of a lid (21). This lid has a through hole (21*b*), with an approximately semi-circular shape, to provide for the passage of a rod or pin (22) making the linking element between the external elements, parts or articles that it is wished to be kept joined, this orifice (21*b*) being in direct communication with an internal tubular shaping (21*c*) that is used as a means of guiding said rod during the movement for the introduction of the latter. The fastening between the lid (21) and the box (18) is carried out by means of tongues (21*a*) which have been fitted to said lid on both opposite shorter sides, finished off at the distal ends with a hook or barb, for introduction of the barbed ends of these pins in the corresponding walls of box (18). Finally, the box (18) also incorporates the necessary electronics on the inside for the interpretation of the signals received from the outside that will activate the electro-magnet (19).

The rod or pin (22) is made from a threaded shape, with an approximately semi-circular shape corresponding to the opening (21*b*) of the lid (21), finished off at one of the ends by a head (22*a*) that by preference has a generally semi-spherical shape, having a diameter that is much greater than the threaded body (22), whilst near the other end there is an annular shaped opening (22*b*).

If the representation is now looked at in FIGS. 11 and 12, the box of the lock can be seen in its closed phase (FIG. 11), and the box completely closed (FIG. 12), with all of the components enclosed on the inside. The perspective view of FIG. 11, allows the electro-magnet (19) to be seen with the end section (19*b*) of its core located in a position facing the discoid piece (20), this situation being held thanks to the step provided by the union between the portions (19*a*-19*b*) of the core, supported directly against the edge of the disc piece (20), this latter piece preventing the core of the electro-magnet from being able to be moved to its end position. In these conditions, when the box is completely closed (FIG. 12) and the opening (21*b*) facing the position of the discoid piece (20), the rod or pin of the union (22) can be introduced through said opening (21*b*), until its end is supported against the discoid piece (20), pushing it against the action of the spring (23), and with it releasing the retention exercised on the core of the electro-magnet (19), in such a way that said core can now move along its entire run, the portion (19*a*) being of greater diameter than that which is now located over the stated discoid piece (20).

This situation has been illustrated in FIGS. 11*a* and 11*b*, in which it is respectively shown that the less moved position of the core of the electro-magnet, in which the edge of the discoid piece (20) prevents a greater axial movement of the core on being supported against the step formed between both portions (19*a*) and (19*b*); this situation corresponds with the non-operating state of the lock, this means, it is not exercising any linking or union task between external parts or elements, as there is no rod (22) linked to the lock. On the other hand, in the position shown in FIG. 11*b*, there is a rod (22) introduced in the lock, as a result of which it has caused the push on the discoid piece (20), and with it the release of the core; with this it has allowed the complete movement of said core towards the outside of the electro-magnet, the portion (19*a*) now being of greater diameter than that which has come into contact with said rod or pin (22), being housed in the perimeter neck (22*b*) of the latter, and with it preventing the rod or pin from being removed; this situation corresponds with the operating state of the lock, and is exactly what happens when a rod or pin (22) is introduced through the opening (21*b*) of the lid, and it is pushed up to the end of its run: the end of the rod takes charge of pushing on the discoid piece (20), and with it releasing the electro-magnet core, and in so doing is held in this position by said core. The extraction of the rod or pin (22) will only be possible when the core is brought back by the application of sufficient tension on the electro-magnet (19), by means of the electronics contained on the inside of the box.

In order to do this, the box also incorporates a connector (24) that is visible in the perspective view that is shown in FIG. 13. In effect, said connector has been fitted on the base of the box on the opposite side to the opening (21*b*) for the introduction of the rod or pin (22), thus keeping it duly protected against effects arising from the constant use of the lock.

As and how was stated at the beginning of the description, the invention has provisioned for the fitting of a release device, conceived and designed to activate the lock and permit the connected pieces or elements to be separated and handled individually, as required. This release device is represented in FIG. 14, and consists of a box (25) on the inside of which there is both the electronics necessary for the generation of the digital signals that are to be communicated to the electronics included in the lock (18), and equally the electrical supply batteries which provide the electrical supply to both the release device components (25) and equally, where appropriate, to the lock components including the electro-magnet (19) itself. In this way, the absence of batteries or other means of supply on the inside of the lock, simplifies its construction and considerably reduces its weight.

The release device (25) is portable, and is logically held by a person or persons who are skilled in the carrying out of the release action when necessary. Externally, the release device only has an on/off switch (26), and press button (10) with the action of which the signals are sent to the lock. It also incorporates an external connector (28), in such a way that an electrical connection can be established between the release device (25) and the lock (18) with the aid of a cable (29) likewise provided with connectors (24') and (28') at its ends respectively, complementary to those on the lock and the release device.

As can be understood, a lock constructed in the manner that has just been described, presents some conceptual characteristics and with a very advantageous design that are simple and easy to put into practice, with the added advantage of providing a very safe union between pieces, elements or articles linked by means of a rod or pin (22). In addition, even though the description has been made on the basis of the lock being of a digital nature on being a technique that is easier to implement and with safer working, the invention likewise provisions for the lock action to be by analogue means, without this meaning any lessening of the features of the assembly.

It is also preferred for the electrical supply both to the release device (25) and equally to the lock itself, to be made on the basis of batteries incorporated into the release device (25). However, it will be understood that the characteristics of the invention will remain unchanged even if the means of providing the electrical supply is modified, to which effect the use of a source that is capable of being connected directly to the electrical network is also envisaged, both for the release device (25) and also for the outside of same.

In that which has been stated above, a description has been made for a way of embodying a digitally activated lock by means of which it is possible to link together two or more pieces that are flat laminated, made from textile, plastic, metal or any other, by means of a rod or pin (22), and whose design characteristics require an external cable that is prepared for connection of the release device to the lock so as to be able to activate the release the lock for the release at will of the elements being retained. However, this means of release could be modified, in alternative versions, in such a way that the releasing action does not demand a cable connection between the release device and the lock activation device, and to this effect, both the release device and equally the lock can include suitable means for a wireless connection from one to the other, either by infra-red, for which the release device will incorporate the means of generating and transmitting the infra-red signals, and the lock will incorporate the means for the reception and control of the signals that can be received at any moment from the release device, or alternatively by radio signals, for which the release device will incorporate a suitable transmitter and the lock will have suitable receiver means fitted, in both cases the connection being wireless, the coded signals in line with the individual codes that can be assigned to each one of the locks.

It is considered unnecessary to make the contents of this present description more extensive so that an expert in the matter is able to understand the scope and advantages that are derived from same. However, experts in the matter will understand that the above description of the preferred embodiment of the invention is capable of having changes and variations that are protected within the sphere of protection of the annexed claims.

The invention claimed is:

1. An integral protective work clothing garment, with releasable retaining elements incorporated, fitted with protective elements for the different parts of the body of the garment user, including a protective helmet, gloves and footwear, wherein a coupling between the differing protective elements and the working garment is made by means of elastic strips, the garment including a safety harness and a retractable element disposed on the garment having a hook adapted to connect to a conventional life line for a user's safety against a possible accidental fall fixing the user to a fixing point, and in that a joint and releasable coupling of each one of the protective elements with the garment is made with a respective lock device, that consists of a box closed by its access base by means of a lid, designed to contain the operating parts of the lock device on the inside, the operating parts consisting of an electro-magnet, a moveable discoid piece and a spring element, the lock device being releasable only by an independent release device consists of a rod or pin capable of being released from the outside, and the independent release device contains signal generating electronics that emit signals necessary for the release of the lock device, and an electrical supply means for the independent release device and the lock device; the rod or pin is formed by a threaded body with a transversal section that is approximately semi-circular corresponding to an opening of the lid of the box, at one end having a semi-spherical shaped head with a larger diameter than the threaded body, and near the other end having a perimeter opening, adapted and sized to allow the insertion of a portion of a core of the electro-magnet into the perimeter opening, so as to retain and prevent the removal of the rod or pin when the lock is in an operative position; and a track housing stitched to the interior of the garment wherein the safety harness is incorporated and moveable in the track housing and directing said safety harness along its entire path.

2. An integral protective work clothing garment, with releasable retaining elements incorporated according to claim 1, wherein it is designed in such a way that the elastic coupling strap for securing the helmet is joined to the piece of garment by means of the collar protruding from the rear edge or neck of the piece of garment;

the elastic coupling strap of each glove to the sleeve of the garment is fixed to the inside of a space formed in the shape of a pocket on each of the sleeves, the inside of which is accessed through an opening through which said elastic strip appears, and the opening of which is capable of being closed with the help of a zip or a similar device;

the boot or shoe has an elastic coupling strip connected to the rear of same, capable of being fixed to the trouser leg of the garment at different heights, this height choice option being provided by the fitting of a strip of a predetermined length, extended to a final section of the trouser leg, and provided with a multiple amount of openings aligned along the length of same.

3. An integral protective work clothing garment, with releasable retaining elements incorporated according to claim 1, wherein each of the elastic strips fitted to each respective protector element has at the end opposed to the end joining the corresponding protecting element an opening for the passage of the retainer device through and for the passage through another correspondingly made opening in the respective coupling position on the garment of each one of said protective elements.

4. An integral protective work clothing garment, with releasable retaining elements incorporated according to claim 1, wherein the box has two transversal walls on the inside, which are parallel and far enough away from each other to constitute the housing for the electro-magnet, and a cavity sized to take the discoid piece with the possibility of movement of the latter on its own axial axis, with the prior incorporation of an intermediary spring compressed by the discoid piece, and the box being closed at its access base by means of a lid, fitted with tongues projecting from the two smaller opposite sides, where the tongues are finished off at the most distal ends in the form of a barb, adapted for introduction in openings made in the corresponding walls of the box, and said lid also having an opening with a generally semi-circular shape, continuing on the inside with a tubular shape which acts as a means of a guide during the movement for the introduction of the pin or rod, the opening of the lid being located in such a position that the position of the lid fitted to the box is substantially facing the discoid piece.

5. An integral protective work clothing garment, with releasable retaining elements incorporated according to claim 4, wherein the electro-magnet has an axially moveable core, in which there are two different cylindrical portions, of which the furthest portion has a diameter that is appreciably less than the portion that is further inside, with a perimeter step determining the union between both portions.

6. An integral protective work clothing garment, with releasable retaining elements incorporated according to claim 5, wherein the core of the electro-magnet is extended over the position of the discoid piece, in such a way that the axial movement of said core, in its non-operating state of the lock is limited with the support of the discoid piece at the perimeter step formed by the union of both portions of said core.

7. An integral protective work clothing garment, with releasable retaining elements incorporated according to claim 4, wherein the core of the electro-magnet is extended over the position of the discoid piece, in such a way that the axial movement of said core, in its non-operating state of the lock is limited with the support of the discoid piece at the perimeter step formed by the union of both portions of said core.

8. An integral protective work clothing garment, with releasable retaining elements incorporated according to claim 1, wherein the release device is fitted with an on/off switch and a press button that is activated to send the signals generated by the release device to the lock, and where the electrical connection with the lock is carried out with the help of an external cable with connectors fitted at the ends that can be respectively connected to other complements fitted to the box of the lock and the release device.

9. An integral protective work clothing garment, with releasable retaining elements incorporated according to claim 1, wherein of the provision of one or more rear, ventral or lateral openings for the coupling of the harness to one or more anti-fall devices, each anti-fall device consisting in a retractable mechanism that is linked to said harness with the insertion of one or several intermediary metallic or non-metallic coupling and support pieces that are jointly complementary, connectable to each other in a releasable manner, and in which the intermediary coupling piece is designed for connecting to the harness, whilst the intermediary support piece is designed to allow its joint coupling with the structure of the retractable mechanism.

10. An integral protective work clothing garment, with releasable retaining elements incorporated according to claim 9, wherein the intermediary coupling piece consists of a flattened body, with a general rectangular prismatic shape, in which two or more through slots have been made along a longitudinal direction of the body, parallel and away from each other, said piece also having a through hole made near to one end thereof.

11. An integral protective work clothing garment, with releasable retaining elements incorporated according to claim 9, wherein the intermediate support piece is made from a flat base, closed at one end by means of a transversal wall, with lateral walls that emerge perpendicular to the base that are finished off with respective tabs, facing inwards, facing each other in respect of the co-planarity, the base of this piece having a through hole in a position near to another end of the transversal wall, and the lateral walls, with their respective tabs, and a far transversal wall form a space that is shaped and sized to correspond with the coupling piece in respect of the flat base, into which it is received and housed in the operating position of the assembly, with a coupling state of both intermediate pieces both respective holes are correspondingly facing each other, so as to allow passage through it of a releasable retainer element guaranteeing coupling of one to the other.

12. An integral protective work clothing garment, with releasable retaining elements incorporated according claim 1, wherein the fabric from which said garment is made can be chosen from the group consisting of reflective or high visibility cloths, fabric used in construction works, fabric used with chemical products, fabric that is electrically insulating, flameproof and heat insulating fabric, or fabric that is usable in line with the ambient temperature, with the inclusion or not of parts of the garment that are specially reinforced for use in specific works.

13. An integral protective work clothing garment, with releasable retaining elements incorporated according to claim 1, wherein of the provision of one or more rear, ventral or lateral openings for the coupling of the harness to one or more anti-fall devices, each anti-fall device consisting in a retractable mechanism that is linked to said harness with the insertion of one or several intermediary metallic or non-metallic coupling and support pieces, that are jointly complementary, connectable to each other in a releasable manner, and in which the intermediary coupling piece is designed for connecting to the harness, whilst the intermediary support piece is designed to allow its joint coupling with the structure of the retractable mechanism.

* * * * *